US011472045B2

(12) United States Patent
Sung

(10) Patent No.: US 11,472,045 B2
(45) Date of Patent: Oct. 18, 2022

(54) KNIFE

(71) Applicant: Shaoching Sung, Chino, CA (US)

(72) Inventor: Shaoching Sung, Chino, CA (US)

( * ) Notice: Subject to any disclaimer, the term of this patent is extended or adjusted under 35 U.S.C. 154(b) by 0 days.

(21) Appl. No.: 17/516,687

(22) Filed: Nov. 1, 2021

(65) Prior Publication Data

US 2022/0134583 A1 May 5, 2022

Related U.S. Application Data

(60) Provisional application No. 63/120,096, filed on Dec. 1, 2020, provisional application No. 63/107,452, filed on Oct. 30, 2020.

(51) Int. Cl.
*B26B 5/00* (2006.01)

(52) U.S. Cl.
CPC ..... *B26B 5/00* (2013.01)

(58) Field of Classification Search
USPC ..... 30/153, 332, 337
See application file for complete search history.

(56) References Cited

U.S. PATENT DOCUMENTS 156,369 A * 10/1874 Willspaugh
333,466 A * 12/1885 Hunter
1,361,021 A * 12/1920 Copeman ..... B25F 1/02 30/337
1,665,955 A * 4/1928 Gatewood ..... B26B 1/04 131/243
1,813,723 A * 7/1931 Beaver ..... B26B 5/00 30/162
4,648,145 A * 3/1987 Miceli ..... B26B 11/003 30/255
4,669,140 A * 6/1987 Miceli ..... B26B 11/006 7/128
6,715,208 B2 4/2004 Lemisch
6,848,183 B2 2/2005 Lemisch
7,325,314 B1 * 2/2008 Chen ..... B23D 51/10 30/337
7,676,930 B1 3/2010 Demko
11,167,435 B2 * 11/2021 Elling ..... B26B 1/10
2007/0204471 A1 9/2007 Castagna
2014/0259687 A1 9/2014 Griffey
2016/0368155 A1 * 12/2016 Mandeville ..... B26B 1/04
(Continued)

FOREIGN PATENT DOCUMENTS

JP 2-292184 * 12/1990

*Primary Examiner* — Hwei-Siu C Payer
(74) *Attorney, Agent, or Firm* — Loza & Loza, LLP; Heidi L. Eisenhut

(57) ABSTRACT

Embodiments of the invention are directed to a folding or butterfly knife that provides for easily changing a blade or other tool on the knife. The knife includes a first handle component; a second handle component; and a knife component. The knife component comprises a blade integrally connected to a tang, pivotally secured to the first and second handle components by an attachment section. The attachment section comprises a first plate; a second plate; an inner plate located between the first and second plates; and a kicker lever for removing and replacing the blade in the knife segment, the kicker lever comprising a protrusion and a kicker located at an upper end of the kicker lever and a lever stop located at a lower end of the kicker lever for defining the movement of the kicker lever.

16 Claims, 7 Drawing Sheets

(56) References Cited

U.S. PATENT DOCUMENTS

| | | | | |
|---|---|---|---|---|
| 2019/0344457 | A1* | 11/2019 | Hunt | B26B 1/046 |
| 2022/0134583 | A1* | 5/2022 | Sung | B26B 1/10 30/165 |

* cited by examiner

KNIFE

BACKGROUND

Field

The present disclosure relates to the field of knives. More specifically, the present disclosure relates to butterfly folding knives, also known as folding pocketknives, having interchangeable blades.

Background

Knives are owned for a variety of reasons. People find knives useful for, by way of example only, their utilitarian purposes (e.g., opening boxes, cutting straps), their defensive purposes (e.g., self-protection), their hunting and outdoor recreational purposes (e.g., field-dressing of hunted game), their usefulness in rescue operations (e.g., cutting through ropes and other bindings, cutting through canvas, and first aid uses). Knives that do not fold are fine but occupy the space of the full length of the knife, from the tip of the blade to the butt of the handle even when the knives are not in use. Additionally, non-folding knives must be stored in a scabbard, which always accompanies the knife. Folding knives offer a benefit of space savings. The blade of the folding knife rotates about its tang and stores within the handle of the knife. The length of a folding knife can therefore be about one-half that of a comparable non-folding knife. Also, because the blade (when in a closed state) is safely secured within the handle of the knife, there is no need to keep the knife in a scabbard. Folding knives can be opened by rotating the blade about its tang from a closed state to an open state. The opening can be done manually, with the assistance of a spring, or automatically using a spring.

Folding knives have been widely used for multiple purposes such as a self-defense tool, cutting instrument etc. Many folding knives pack various tools within the handle, such as a screwdriver and wine opener, along with the blade. However, multiple tools folded into the handle of the knife not only make it inconvenient for the users to quickly find the correct tool but also make the handle large and bulky making the knife difficult to carry.

A butterfly knife is a type of folding knife that includes a single blade pivotably connected to two handle halves. The handle halves each rotate around the blade such that, when closed, the blade is concealed within grooves in the handle halves, and when opened, the blade extends from both of the handle halves. Due to the construction of the butterfly knife, the butterfly knife can quickly be manipulated, or flipped, from a closed to an opened position using one hand.

There are many designs for folding or butterfly knives, but known designs fail to provide for a portable knife that is easy to carry and where the blade can be easily removed from the knife and replaced on the fly with a different blade, implement, or other tool. Additionally, known latching mechanisms, which keep the blade attached to the handles may be cumbersome to use, have too many parts, are not ergo dynamically satisfying, or any combination of these and other drawbacks. Accordingly, a butterfly knife that overcomes these and/or other obstacles is needed.

SUMMARY

The following presents a summary of one or more aspects of the present disclosure, in order to provide a basic understanding of such aspects. This summary is not an extensive overview of all contemplated features of the disclosure and is intended neither to identify key or critical elements of all aspects of the disclosure nor to delineate the scope of any or all aspects of the disclosure. Its sole purpose is to present some concepts of one or more aspects of the disclosure in a form as a prelude to the more detailed description that is presented later.

In one aspect, a folding knife having an open state and a closed state is provided. The folding knife comprises a first handle component; a second handle component; and a knife component. The knife component comprises a blade integrally connected to a tang, pivotally secured to the first and second handle components by an attachment section. The attachment section comprises a first plate; a second plate; an inner plate located between the first and second plates; and a kicker lever for removing and replacing the blade in the knife segment, the kicker lever comprising a protrusion and a kicker located at an upper end of the kicker lever and a lever stop located at a lower end of the kicker lever for defining the movement of the kicker lever.

In one feature, the first handle component comprises a first outer portion and a second outer portion, the first outer portion a mirror image of the second outer portion.

In another feature, the second handle component comprises a first outer portion and a second outer portion, the first outer portion a mirror image of the second outer portion.

In yet another feature, the tang includes an upper recess and a lower recess integrally formed in the tang for detachably securing the knife segment to the attachment section.

In yet another feature, the attachment section further comprises a first blade pin and a second blade pin connecting the first plate to the second plate.

In yet another feature, the upper recess of the tang is adapted to receive the protrusion of the kicker lever and the second blade pin is adapted to receive the second blade pin.

In yet another feature, the first blade pin is adapted to be received withing kicker lever opening.

In yet another feature, the inner plate includes an opening adapted to receive the lever stop and an inner plate recess, the inner plate recess adapted to receive a spring and abut the lever stop controlling the movement of the kicker lever.

In one aspect, a folding knife having an open state and a closed state is provided. The knife includes a first handle component; a second handle component; and a knife segment. The knife segment comprises a blade integrally connected to a tang, pivotally secured to the first and second handle components by an attachment section. The first attachment section includes a first plate; a second plate; an inner plate located between the first and second plates; and a kicker lever for removing and replacing the blade in the knife segment, the kicker lever comprising a protrusion and a kicker located at an upper end of the kicker lever and a lever stop located at a lower end of the kicker lever for defining the movement of the kicker lever; and a first blade pin and a second blade pin connecting the first plate to the second plate.

In one feature, the tang includes an upper recess and a lower recess integrally formed in the tang for detachably securing the knife segment to the attachment section.

In another feature, the upper recess of the tang is adapted to receive the protrusion of the kicker lever and the second blade pin is adapted to receive the second blade pin.

In yet another feature, the first blade pin is adapted to be received within the kicker lever opening.

In yet another feature, the inner plate includes an opening adapted to receive the lever stop and an inner plate recess, the inner plate recess adapted to receive a spring and abut the lever stop controlling the movement of the kicker lever.

In yet another feature, the first handle component comprises a first outer portion and a second outer portion, the first outer portion a mirror image of the second outer portion.

In yet another feature, the second handle component comprises a first outer portion and a second outer portion, the first outer portion a mirror image of the second outer portion.

In one aspect, a folding knife having an open state and a closed state is provided. The knife comprises a first handle component; a second handle component; and a knife segment, comprising a blade integrally connected to a tang, pivotally secured to the first and second handle components by an attachment section. The attachment section comprises a first plate; a second plate; an inner plate located between the first and second plates; a kicker lever for removing and replacing the blade in the knife segment, the kicker lever comprising a protrusion and a kicker located at an upper end of the kicker lever and a lever stop located at a lower end of the kicker lever for defining the movement of the kicker lever; and a first blade pin and a second blade pin connecting the first plate to the second plate. The inner plate includes an opening adapted to receive the lever stop and an inner plate recess, the inner plate recess adapted to receive a spring and abut the lever stop controlling the movement of the kicker lever. The tang includes an upper recess and a lower recess integrally formed in the tang for detachably securing the knife segment to the attachment section. The upper recess of the tang is adapted to receive the protrusion of the kicker lever and the second blade pin is adapted to receive the second blade pin. The first blade pin is adapted to be received within the kicker lever opening.

BRIEF DESCRIPTION OF THE DRAWINGS

Various features, nature, and advantages may become apparent from the detailed description set forth below when taken in conjunction with the drawings in which like reference characters identify correspondingly throughout.

DETAILED DESCRIPTION

In the following description, specific details are given to provide a thorough understanding of the described implementations. However, it will be understood by one of ordinary skill in the art that the implementations may be practiced without these specific details. For example, well-known structures may not be shown in detail in order not to obscure the implementations of the subject matter disclosed herein.

The term "blade" may refer to any type of tool or implement that is capable of being secured within handles of a butterfly knife.

Overview

Embodiments of the invention are directed to a folding or butterfly knife that provides for easily changing a blade or other tool on the knife. The knife includes a first handle component; a second handle component; and a knife component. The knife component comprises a blade integrally connected to a tang, pivotally secured to the first and second handle components by an attachment section. The attachment section comprises a first plate; a second plate; an inner plate located between the first and second plates; and a kicker lever for removing and replacing the blade in the knife segment, the kicker lever comprising a protrusion and a kicker located at an upper end of the kicker lever and a lever stop located at a lower end of the kicker lever for defining the movement of the kicker lever.

Butterfly Knife

Figure 1:
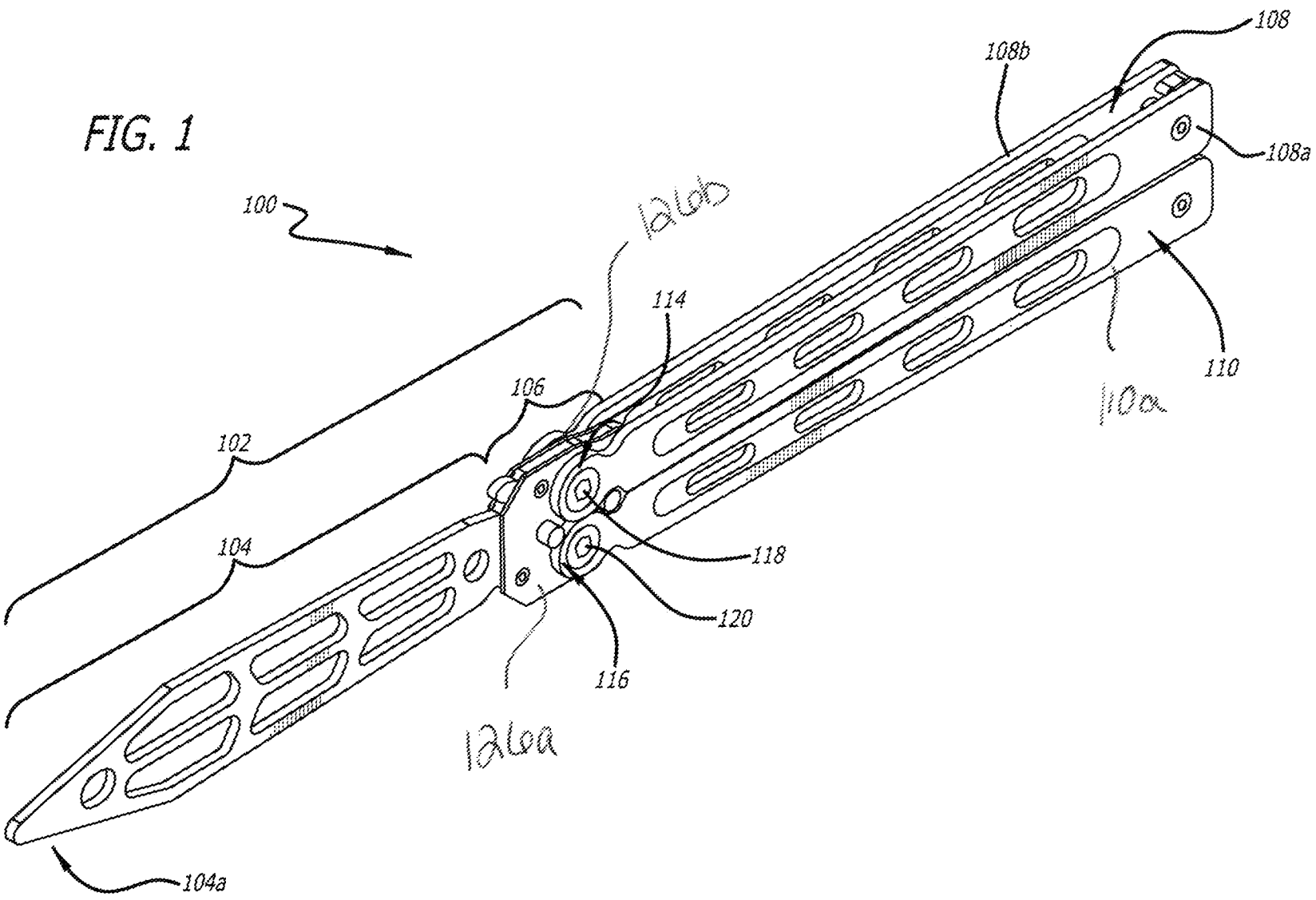
FIG. 1 is a top-front-left perspective view of one example of a butterfly knife in an open and locked state, according to aspects described herein.
Figure 2:
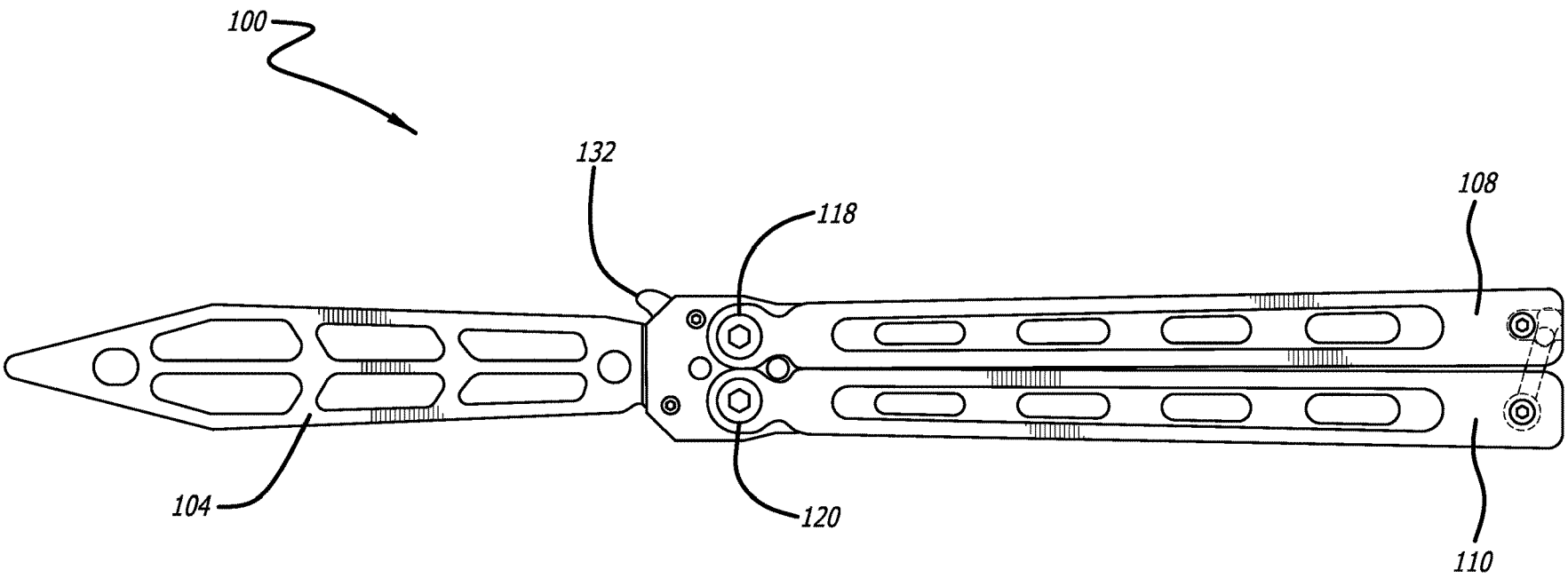
FIG. 2 is a left-side elevation view of the butterfly knife of FIG. 1.
Figure 3:
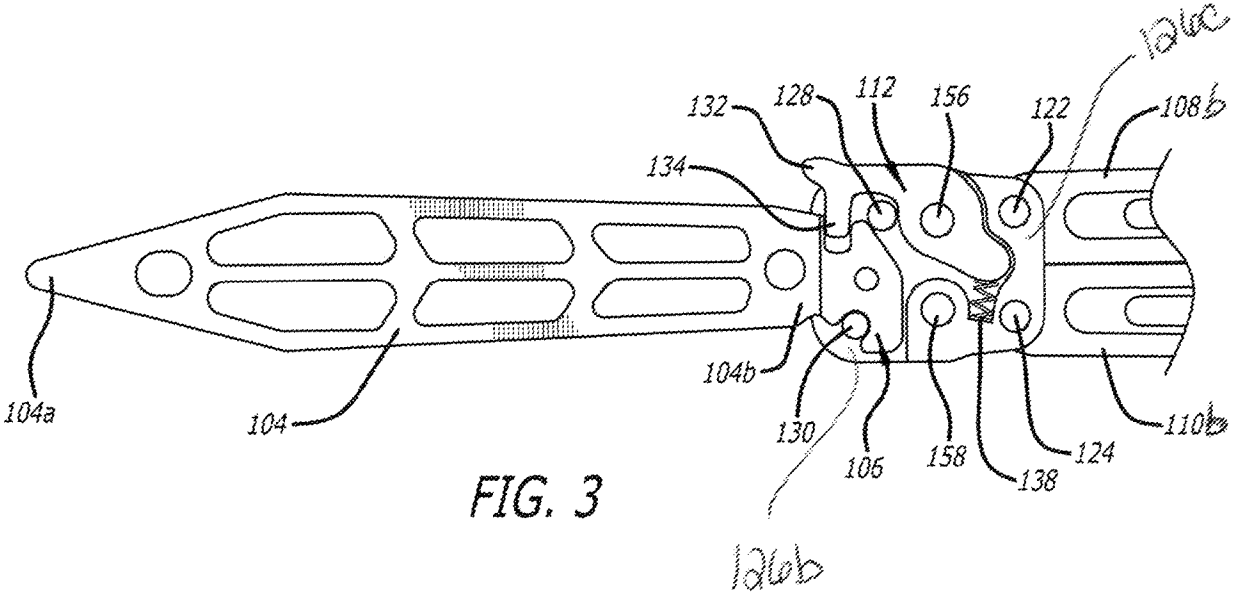
FIG. 3 is a partial left-side elevation view of the butterfly knife of FIG. 1 with a kicker lever in a closed position.
Figure 4:
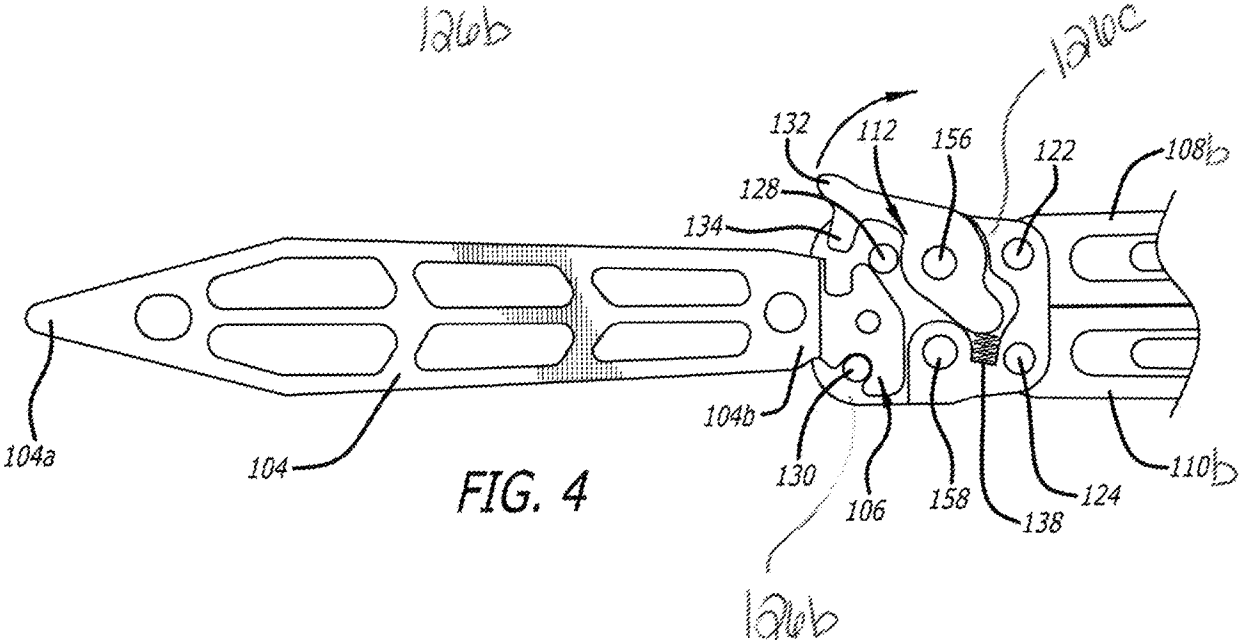
FIG. 4 is a partial left-side elevation view of the butterfly knife of FIG. 1 with a kicker lever in an open configuration.
Figure 6:
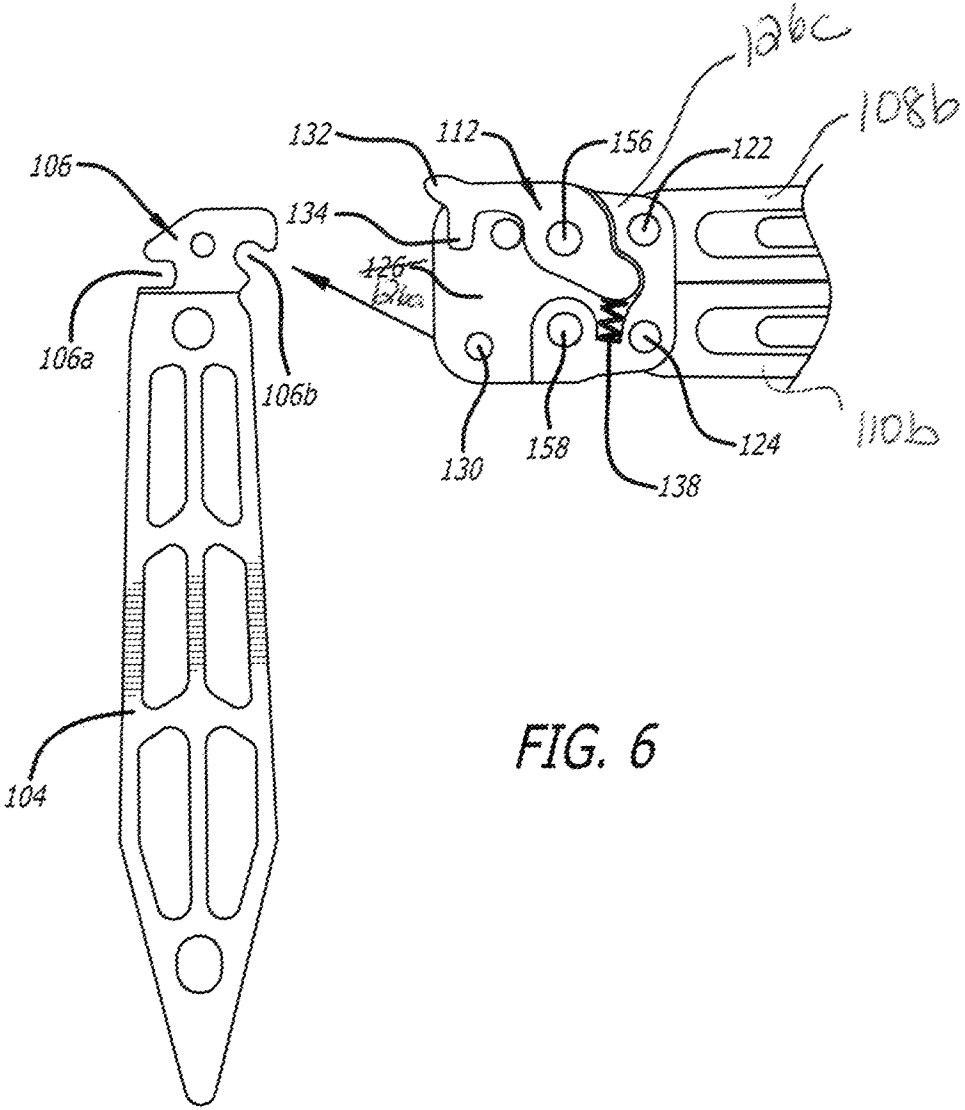
FIG. 6 is a partial left-side elevation view of the butterfly knife of FIG. 1 with the blade catch mechanism in the unlocked position configuration and the blade removed.
Figure 5:
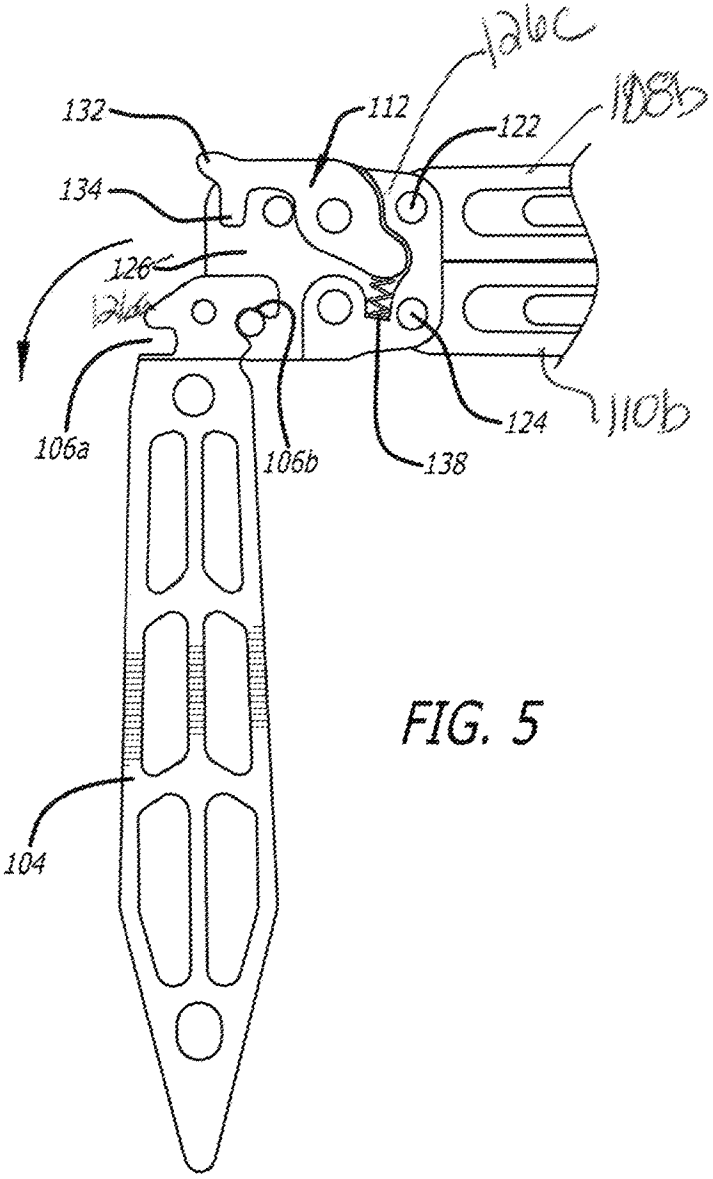
FIG. 5 is a partial left-side elevation view of the butterfly knife of FIG. 1 with the kicker lever in an unlocked position with the blade secured.
Figure 7:
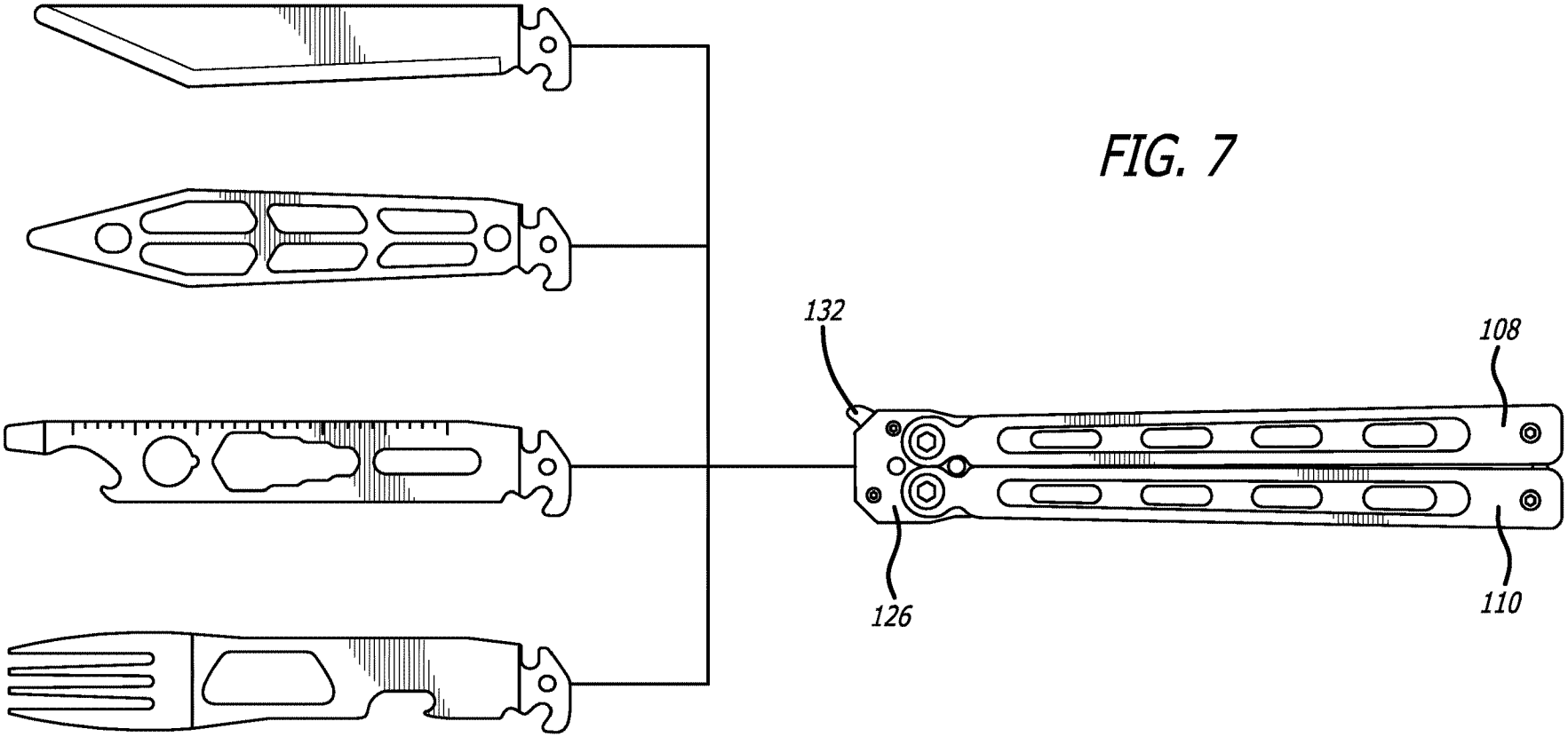
FIG. 7 is a left-side elevation view of the butterfly knife of FIG. 1 with the blade removed and showing optional blades or tools for attachment.
Figure 8:
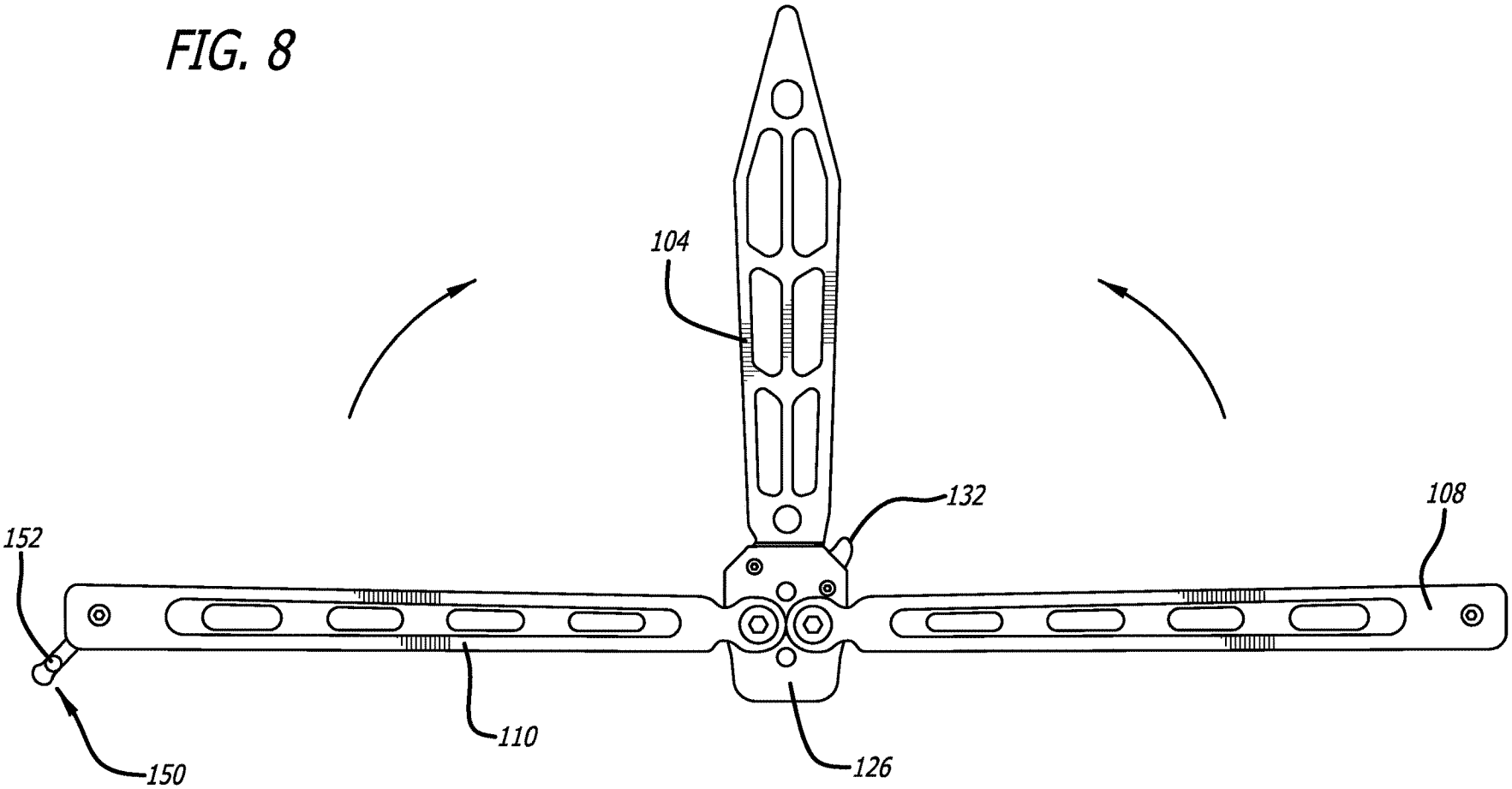
FIG. 8 is a left-side facing view of the butterfly knife of FIG. 1 that is in a half open state or position.
Figure 9:
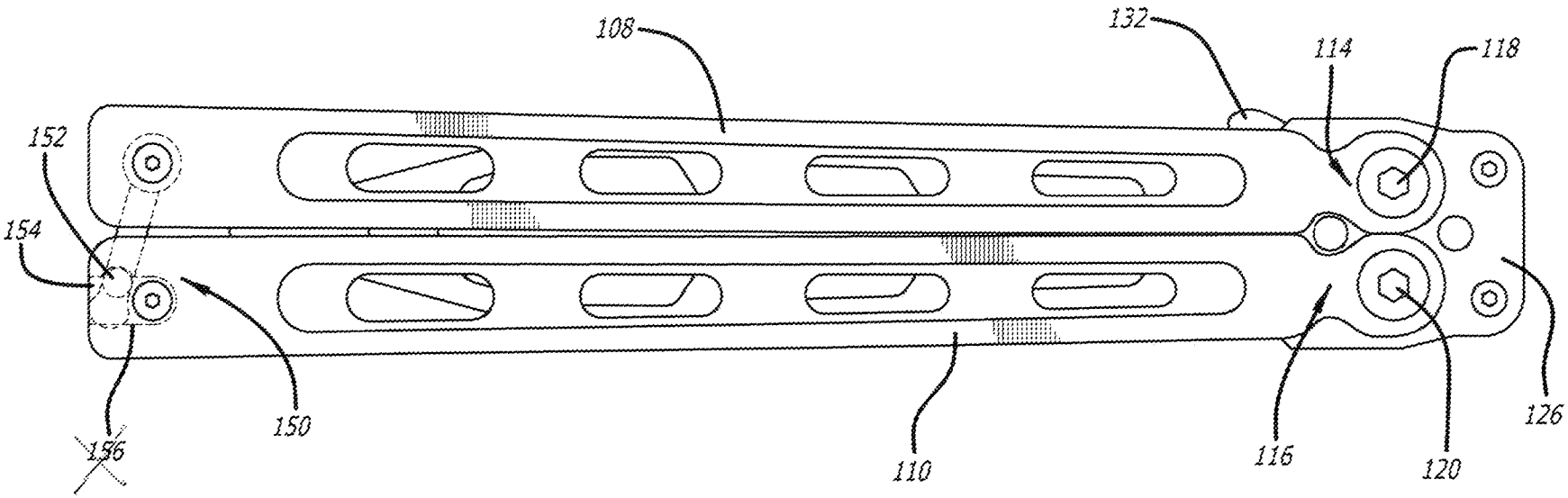
FIG. 9 is a left-side elevation view of the butterfly knife of FIG. 1 in a closed position.

FIG. 1 is a top-front-left perspective view of one example of a butterfly knife in an open and locked state, according to aspects described herein. FIG. 2 is a left-side elevation view of the butterfly knife of FIG. 1. FIG. 3 is a partial left side elevation view of the butterfly knife of FIG. 1 with a kicker lever in a closed position. FIG. 4 is a partial left-side elevation view of the butterfly knife of FIG. 1 with a kicker lever in an open configuration. FIG. 5 is a partial left side elevation view of the butterfly knife of FIG. 1 with the kicker lever in an unlocked position with the blade secured. FIG. 6 is a partial left-side elevation view of the butterfly knife of FIG. 1 with the kicker lever in the unlocked position configuration and the blade removed. FIG. 7 is a left-side elevation view of the butterfly knife of FIG. 1 with the blade removed and showing optional blades or tools for attachment. FIG. 8 is a left side facing view of the butterfly knife of FIG. 1 that is in a half open position. FIG. 9 is a left side elevation view of the butterfly knife of FIG. 1 in a closed position. The following discussion refers interchangeably to FIGS. 1-9.

Turning to FIG. 1, a top-front-left perspective view of one example of a butterfly knife 100 in an open and locked state is shown. The butterfly knife 100 may be a folding knife. The butterfly knife 100 may include a knife segment 102, which may be comprised of a blade 104 (or other tool or implement) having a tang 106, the blade 104 being integral with the tang 106 (e.g., the two being formed as one). The butterfly knife 100 further includes a first handle component 108 and a second handle component 110 hinged to the knife segment by an attachment section 126. The attachment section 126 comprises a first plate 126*a*, a second plate 126*b*, and an inner plate 126*c*, the inner plate 126*c* located between the first and second plates 126*a*, 126*b* and secured together by a pair of pins 122, 124. A kicker lever 112 further included in the attachment section 126 between the first and second plates 126*a*, 126*b*. As described in further detail below, the kicker lever 112 provides for easily removing and replacing the blade 104 with a different blade, tool, or implement using a single hand.

Although a blade is shown, this is by way of example only and any tool or implement that can be stored inside the handle portion of a knife may be utilized, including but not limited to, a nail file, scissors, pliers, fork, spoon, can opener, corkscrew, and tweezers.

The knife segment 102 may be made of any metal suitable to function as a knife that is known to the person of ordinary skill. The knife segment 102 may be manufactured as an article of manufacture that may be, for example, forged and ground, stamped and ground, or formed by any known set of operations as known and understood by the person of ordinary sill in the art. The preceding lists are exemplary and non-limiting.

The first and second handle components 108, 110 and internal components of the folding knife 100 may be made of a metal, a plastic, a combination thereof, or some other similar materials or combinations of materials. The preceding lists are exemplary and non-limiting. Each of the first handle component 108 and the second handle component 110 may be manufactured as an article of manufacture that may be, for example, milled, stamped, pressed, molded or any combination thereof. The decorative features of the first and second handle components 108, 110 may be primarily non-functional; however, the gaps in the first and second handle components 108, 110 may be present to lighten the overall weight of the knife 100 (e.g., by removal of material from the gaps). Ridges and embossing on the first and second handle components 108, 110 and the knife segment 102 may be present to improve hand-gripping and finger manipulation; they may provide non-smooth surfaces on which to grip the first and second handle components 108, 110, manipulate the knife segment 102, or a combination thereof.

The blade 104, having a proximal end 104*a* and distal end 104*b*, is integral with the tang 106, connected at the distal end of the blade 104. Furthermore, the proximal ends 114, 116 of the first handle component 108 and the second handle component 110, respectively, are hingedly coupled to the attachment section 126, allowing the butterfly knife 100 to move between an open state (or position) and a closed state (or position). The first and second handle components 108, 110 counter-rotate around the attachment section 126 such that, when closed, the blade 104 is concealed within the first and second handle components 108, 110.

The first handle component 108 may be comprised of a first outer portion 108*a* and a second outer portion 108*b*. According to one aspect, the first outer portion 108*a* and the second outer portion 108*b* may face each other and be mirror copies of each other. The second handle component 110 may be comprised of a first outer portion 110*a* and a second outer portion 110*b*. According to one aspect, the first outer portion 110*a* and the second outer portion 110*b* may face each other and be mirror copies of each other.

The blade 104 is pivotally attached to each handle component 108, 110 separately via the attachment section 126. A first pivot pin 118 having a first shaft 156 and a second pivot pin 120 having a second shaft 158 extend through the attachment section 126 securing the handle components 108, 110 to the blade 104 and allowing the first and second handle components 108, 110 to counter-rotate around the attachment section 126. The attachment section 126 further includes a first blade pin 128 and a second blade pin 130 for securing the tang 106 within the attachment section 126, as discussed in further detail below. The first blade pin 128 is adapted to be received within a kicker lever opening preventing the kicker lever 112 from over rotating.

Turning to FIGS. 3-6, partial left-side elevation views of the butterfly knife of FIG. 1 with the first plate of the attachment section 126, the first outer portion 108*a* of the first handle component 108, and the first outer portion 110*a* of the second handle component 110 removed are illustrated. Removing first plate of the attachment section 126 and the first outer portions 108*a*, 110*a* of the first and second handle components 108, 110 shows the kicker lever 112 in a closed position (FIG. 3), an open position (FIG. 4), an unlocked position with the knife segment secured (FIG. 5), and unlocked position configuration with the knife segment removed (FIG. 6), respectively.

The kicker lever 112 may be used to easily change and replace the knife segment 102 on the fly. As discussed previously and shown in FIG. 7, the knife segment 102 may include a screwdriver, fork, or a bottle opener integrally connected to the tang 106. The tang 106 may include an upper recess 106*a* and an opposing lower recess 106*b* integrally formed in the tang 106 for detachably securing the knife segment 102 to the attachment section 126 as described below.

In the open state, the kicker lever 112 may serve as a finger guard, to, for example, prevent the index finger of the hand gripping the folding knife 100 from contacting sharp edges of the blade 104. In the closed state, the kicker lever 112 may serve as a lever that can be contacted, for example, by the index finger of the hand gripping the folding knife 100 and pulled to begin, and carry out, the process of replacing the knife segment 102. The kicker lever 112 further includes a protrusion 132 and a kicker 134 located at an upper end and a lever stop 135 located at the lower end defining the movement of the kicker lever 112. The lever stop 135 of the kicker lever 112 is received within an opening or cut out of the inner plate 126*c* of the attachment section 126, the shape of the opening or cut out matching the outer shape surface of the lever stop 135 where the opening is adapted to receive the lever stop 135. A spring 138 located in a recess of the inner plate 126*c* abuts the lever stop controlling the movement of the kicker lever 112.

Rotation of the kicker lever 112 about the first shaft 156 of the first pivot pin 118 causes the kicker lever 112 to operate between a closed position and an open position locking and unlocking the tang 106 to the attachment section 126, respectively. When in the closed position, the kicker 134 of the kicker lever 112 is securely received in the upper recess 106*a* of the tang 106.

FIG. 7 is a left-side elevation view of the butterfly knife 100 of FIG. 1 with the blade 104 removed and showing optional blades for attachment. To dissemble the butterfly knife 100 and remove and replace the knife segment 102, an index finger of the hand pulls upward on the protrusion 132 of the kicker lever 112 releasing the kicker 134 from within the upper recess 106*a* of the tang 106 rotating the kicker lever 112. As the kicker lever 112 is pulled upward, the lever stop presses down on the compression spring 138 causing the compression spring to compress unlocking the knife segment 102. As the knife segment 102 rotates counter-clockwise around the second blade pin 130, the blade 104 is pulled upwardly to the left causing the tang 106 of the knife segment 102 to detach from the attachment section 126. According to one embodiment, the blade 104 is rotated 90 degrees, or approximately 90 degrees, around the second blade pin 130. To install a new blade or other tool to the attachment section 126, the tang 106 of a knife segment 102 is inserted into the attachment section 126 and the second blade pin 130 is received within the lower recess 106*b* of the tang 106. Once the second blade pin 130 is received and secured within the lower recess 106*b* of the tang 106, the knife segment 102 is rotated 90 degrees, or approximately 90 degrees, around the second blade pin 130 in a clockwise direction until the kicker lever 112 is received in the upper recess 106*a* securing and locking the knife segment 102 within the attachment section 126.

Handle Hatch Lock

The butterfly knife 100 may be locked when in both the open state and the closed state. In one configuration, handle latch lock 150 may be utilized. The handle latch lock 150 comprises a handle latch 154, a spring 157 securing the handle latch 154 to the second handle component 110, and a recess within the distal end of the first handle component 108. The handle latch 154 is configured to be received in the recess.

To unlock the butterfly knife 100, the first handle component 108 and the second handle component 110 may be gripped together using a single hand releasing or extruding the adjustable latch 152 from the recess. When the first and second handle components 108, 110 are pressed together, the spring 157 in the second handle component 110 is compressed releasing the adjustable latch 152, unlocking the handle latch lock 150 detaching the first handle component 108 and the second handle component 110. Once detached, the first handle component 108 and the second handle component 110 may rotate independent of each other around the shafts 156, 158 of the first and second pivot pins 118, 120 respectively.

To lock the butterfly knife 100, the first and second handle components 108, 110 are paired up or brought together with a single hand. Next, the handle latch 150 is toggled until the adjustable latch 152 is received and locked within the recess. Upon releasing the grip on the first and second handle components 108, 110, the spring 157 is released securing the adjustable latch 152 within the recess locking the first and second handle components 108, 110 together preventing the first and second handle components 108, 110 from rotating around the shafts 156, 158 of the first and second pivot pins 118, 120 respectively.

One or more of the components, processes, features, and/or functions illustrated in FIGS. 1-9 may be rearranged and/or combined into a single component, process, feature, or function or embodied in several components, processes, or functions. Additional elements, components, processes, and/or functions may also be added without departing from the scope of this disclosure. The word "exemplary" is used herein to mean "serving as an example, instance, or illustration." Any implementation or aspect described herein as "exemplary" is not necessarily to be construed as preferred or advantageous over other implementations or aspects described herein. Likewise, the term "aspects" does not require that all aspects of this disclosure include the discussed feature, advantage, or mode of operation.

The term "coupled" is used herein to refer to the direct or indirect coupling between two objects. For example, if object A physically touches object B, and object B touches object C, then objects A and C may still be considered coupled to one another—even if they do not directly physically touch each other.

The construct "A and/or B" means "A, B, or both."

Also, it is noted that various disclosures contained herein may be described as a process that is depicted as a flowchart, a flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed.

While the foregoing disclosure shows illustrative aspects, it should be noted that various changes and modifications could be made herein without departing from the scope of this disclosure as defined by the appended claims. The functions, steps and/or actions of the method claims in accordance with the embodiments described herein need not be performed in any particular order. Furthermore, although elements of aspects may be described or claimed in the singular, the plural is contemplated unless restriction to the singular is explicitly stated.

The previous description of the disclosed aspects is provided to enable any person skilled in the art to make or use the aspects described herein. Various modifications to these aspects will be readily apparent to those skilled in the art, and the generic principles defined herein may be applied to other aspects without departing from the spirit or scope of this disclosure. Thus, the present subject matter is not intended to be limited to the aspects shown herein but is to be accorded the widest scope consistent with the principles and novel features disclosed herein.

Although the present subject matter and its advantages have been described in detail, it should be understood that various changes, substitutions and alterations can be made herein without departing from the spirit and scope of this disclosure as defined by the appended claims.

Moreover, the scope of the present disclosure is not intended to be limited to the particular aspects of the process, machine, manufacture, composition of matter, means, methods and steps described herein. As one of ordinary skill in the art will readily appreciate from this disclosure of the present subject matter, processes, machines, manufacture, compositions of matter, means, methods, or steps, presently existing or later to be developed that perform substantially the same function or achieve substantially the same result as the corresponding features described herein may be utilized according to the present disclosure. Accordingly, the appended claims are intended to include within their scope such processes, machines, manufacture, compositions of matter, means, methods, or steps.

What is claimed is:

1. A folding knife having an open state and a closed state, comprising:

a first handle component;

a second handle component;

a knife segment, comprising a blade integrally connected to a tang, pivotally secured to the first and second handle components by an attachment section, the attachment section comprising:

a first plate;

a second plate;

an inner plate located between the first and second plates; and a kicker lever for removing and replacing the knife segment, the kicker lever comprising a protrusion and a kicker located at an upper end of the kicker lever and a lever stop located at a lower end of the kicker lever for defining the movement of the kicker lever.

2. The knife of claim 1, wherein the first handle component comprises a first outer portion and a second outer portion, the first outer portion a mirror image of the second outer portion.

3. The knife of claim 1, wherein the second handle component comprises a first outer portion and a second outer portion, the first outer portion a mirror image of the second outer portion.

4. The knife of claim 1, wherein the tang includes an upper recess and a lower recess integrally formed in the tang for detachably securing the knife segment to the attachment section.

5. The knife of claim 4, wherein the attachment section further comprises a first blade pin and a second blade pin connecting the first plate to the second plate.

6. The knife of claim 5, wherein the upper recess of the tang is adapted to receive the kicker.

7. The knife of claim 6, wherein the first blade pin is adapted to be received within a kicker lever opening.

8. The knife of claim 1, wherein the inner plate includes an opening adapted to receive the lever stop and an inner plate recess, the inner plate recess adapted to receive a spring and abut the lever stop controlling the movement of the kicker lever.

9. A folding knife having an open state and a closed state, comprising:

a first handle component;

a second handle component;

a knife segment, comprising a blade integrally connected to a tang, pivotally secured to the first and second handle components by an attachment section, the attachment section comprising:

a first plate;

a second plate;

an inner plate located between the first and second plates;

a kicker lever for removing and replacing the knife segment, the kicker lever comprising a protrusion and a kicker located at an upper end of the kicker lever and a lever stop located at a lower end of the kicker lever for defining the movement of the kicker lever; and a first blade pin and a second blade pin connecting the first plate to the second plate.

10. The knife of claim 9, wherein the tang includes an upper recess and a lower recess integrally formed in the tang for detachably securing the knife segment to the attachment section.

11. The knife of claim 10, wherein the upper recess of the tang is adapted to receive the kicker.

12. The knife of claim 11, wherein the first blade pin is adapted to be received within a kicker lever opening.

13. The knife of claim 11, wherein the inner plate includes an opening adapted to receive the lever stop and an inner plate recess, the inner plate recess adapted to receive a spring and abut the lever stop controlling the movement of the kicker lever.

14. The knife of claim 9, wherein the first handle component comprises a first outer portion and a second outer portion, the first outer portion a mirror image of the second outer portion.

15. The knife of claim 9, wherein the second handle component comprises a first outer portion and a second outer portion, the first outer portion a mirror image of the second outer portion.

16. A folding knife having an open state and a closed state, comprising:

a first handle component;

a second handle component;

a knife segment, comprising a blade integrally connected to a tang, pivotally secured to the first and second handle components by an attachment section, the attachment section comprising:

a first plate;

a second plate;

an inner plate located between the first and second plates;

a kicker lever for removing and replacing the knife segment, the kicker lever comprising a protrusion and a kicker located at an upper end of the kicker lever and a lever stop located at a lower end of the kicker lever for defining the movement of the kicker lever;

a first blade pin and a second blade pin connecting the first plate to the second plate; and wherein the inner plate includes an opening adapted to receive the lever stop and an inner plate recess, the inner plate recess adapted to receive a spring and abut the lever stop controlling the movement of the kicker lever;

wherein the tang includes an upper recess and a lower recess integrally formed in the tang for detachably securing the knife segment to the attachment section;

wherein the upper recess of the tang is adapted to receive the kicker; and wherein the first blade pin is adapted to be received within a kicker lever opening.

* * * * *